US006243867B1

(12) United States Patent
Faison

(10) Patent No.: US 6,243,867 B1
(45) Date of Patent: Jun. 12, 2001

(54) PERSPIRATION ABSORBENT ARM BAND

(76) Inventor: Charles Rudolph Faison, 1530 N. Payson St., Baltimore, MD (US) 21217

( * ) Notice: Subject to any disclaimer, the term of this patent is extended or adjusted under 35 U.S.C. 154(b) by 0 days.

(21) Appl. No.: 09/037,731

(22) Filed: Mar. 9, 1998

(51) Int. Cl.[7] ..... A41D 13/08
(52) U.S. Cl. ..... 2/16; 2/46; 2/59
(58) Field of Search ..... 2/16, 59, 29, 21, 2/22, 902, 267–268, 46; 602/1, 2, 20, 22, 23, 41, 42, 48, 60

(56) References Cited

U.S. PATENT DOCUMENTS 1,304,558 * 5/1919 Grau ..... 2/16
1,837,148 * 12/1931 Davis ..... 2/59
1,997,956 * 4/1935 Whitaker ..... 2/59
3,446,880 * 5/1969 Enicks ..... 2/267
4,048,674 * 9/1977 Chesnick ..... 2/16
4,120,052 * 10/1978 Butler ..... 2/16
4,665,562 * 5/1987 Winer ..... 2/22
5,056,157 * 10/1991 Pryor ..... 2/16

* cited by examiner

*Primary Examiner*—Gloria M. Hale
(74) *Attorney, Agent, or Firm*—Law Offices of Royal W. Craig

(57) ABSTRACT

An absorbent wiping band that is specifically adapted to be releasably and conformably fastened around the forearm, elbow and upper arm to expose an absorbent strip of material extending upwardly along the upper arm beginning at the elbow such that when the arm is straightened the absorbent band is even with the wearer's forehead and can be manipulated to wipe the forehead for removal of perspiration.

6 Claims, 3 Drawing Sheets

PERSPIRATION ABSORBENT ARM BAND

BACKGROUND OF THE INVENTION

1. Field of the Invention

The present invention relates to perspiration absorbent articles of clothing and, more particularly, to a self-attachable overlay for the upper arm and forearm which provides a convenient perspiration-absorbent wipe.

2. Description of the Background

There are a variety of available protective pads that can be worn in various locations to serve as a bandage, protect specific body parts, and/or protect the wearer's clothing.

For instance, U.S. Pat. No. 1,304,558 shows an elbow pad designed to keep a cram applied to the elbow from rubbing off.

U.S. Pat. No. 1,997,956 shows a shirt sleeve protector.

U.S. Pat. No. 4,048,674 shows a protective guard for archers that is adapted to be releasably and fastened around an archer's forearm directly behind the hand which holds the bow to prevent accidental injury to the arm and elbow if the bowstring is improperly released.

Some of these prior art devices have a view toward advertising. For instance, U.S. Pat. No. 1,837,148 shows an advertising wrist band.

However, none of these or any other known prior art devices are specifically adapted to provide a convenient cloth wiping panel for absorbing perspiration from the forehead or other areas. As a result, the when the user works up a seat the inclination is to wipe the forehead with the shirt sleeve, thereby staining the shirt. It would be greatly advantageous to provide a perspiration absorbent wiping band to be releasably and conformably fastened around the upper arm with an absorbent strip of material extending upwardly from the wrist and along the forearm around the elbow and to the upper arm such that when the arm is straightened the absorbent band is even with the wearer's forehead and can be manipulated to wipe the forehead for removal of perspiration therefrom.

SUMMARY OF THE INVENTION

It is, therefore, an object of the present invention to provide an improved perspiration absorbent wiping band that is specifically adapted to be releasably and conformably fastened around the upper rm and forearm to expose an absorbent strip of material extending upwardly along the forearm and upper arm beginning at the wrist such that when the arm is straightened the absorbent band is even with the wearer's forehead and can be manipulated to wipe the forehead for removal of perspiration.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENT

The absorbent wiping band according to the present invention is best constructed with the following starting materials:

1. A strip of 100% cotton cloth or other durable absorbent fabric;

2. A strip of 100% cotton batting, needled or non-needled, or other absorbent filler material;

3. A plurality of fasteners such as buttons, hook and loop fasteners, snap fasteners, etc.

4. A pair of elastic fabric ribbons;

5. Cotton thread and a needle, scissors and measuring tape for sewing;

6. Optional decals or appliques for advertising or promotional purposes.

Given the above, the absorbent wiping band is constructed according to the following steps:

1st. Covers 1, 3.

Figure 1:
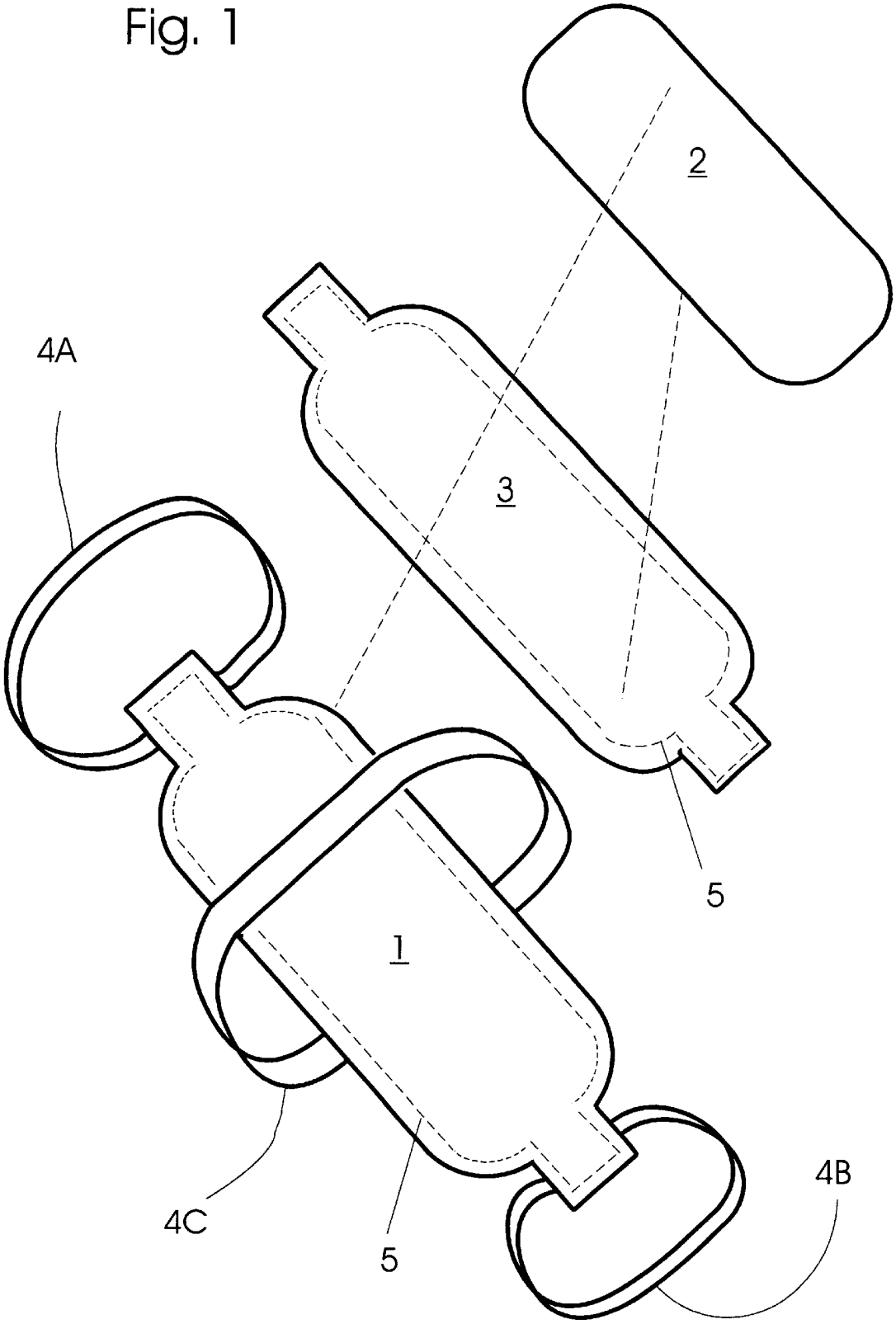
FIG. 1 is an exploded view of the absorbent wiping band according to the present invention.

As shown in the exploded view of FIG. 1, using the 100% cotton fabric described above, two outer covers 1, 3 of the absorbent wiping band are cut to the desired width of four to six and one-half inch inches for the average wearer. These dimensions are equal to approximately half the circumference of the biceps to ensure conformity with the upper arm. The two outer covers 1, 3 of the absorbent wiping band are cut to a length of twenty four to thirty-six inches for the average wearer. This dimension equals approximately the length from the top of the biceps to an inch short of the wrist. The shape of both outer covers 1, 3 is a shallow rounded strip with stems at each end as illustrated in FIG. 1.

$2^{nd}$: The outer covers 1, 3 are then placed overlapping with the finished sides of these two pieces placed against each other. The outer covers 1, 3 are then sewn with thread around the edges on three sides leaving the fourth side open. The joined outer covers 1, 3 are then inverted to expose the sewn sides.

$3^{rd}$: The Lining

The afore-mentioned 100% cotton batting is cut to the very same shape and dimensions as the covers 1, 3 but one-quarter of an inch smaller around the entire circumference to form an absorbent liner 2 as in FIG. 1. The absorbent liner 2 is inserted into or between the inverted covers 1, 3 and is adjusted to fit smoothly.

$4^{th}$: The Closing

There are two alternate methods of closing the body of the absorbent wiping band. According to one, the open end of the absorbent wiping band covers 1, 3 are tucked in to closed position and the entire circumference is stitched one-quarter of an inch from the edge thus securing the absorbent liner 2 in place and making it a permanent part of the absorbent wiping band. Alternately, the body of the absorbent wiping band may be temporarily closed by sewing the above-described fasteners (hook and loop, snaps, etc.) to the open end of the covers 1, 3 and then pressing closed. This allows the absorbent liner 2 to be easily inserted and removed for cleaning and reuse.

$5^{th}$: The Bands

As seen in FIG. 1, the bands or straps 4A–C are now created and attached. Bands or straps 4A–C are used to hold the body of the absorbent wiping band in place. The Bands 4A–C are cut to different lengths ranging from approximately three inches to thirty inches long, the median for band 4A to accommodate the circumference of the elbow, the greater for band 4C to accommodate the wrist, and one for band 4B to fit the upper arm above the biceps (which may or may not be bare). The width of all the assembled bands 4A–4C is one-quarter inch to two inches as a matter of design choice. The bands 4A–C may be commercially available elastic fabric strips or may be constructed from raw fabric panels. In the latter case, a piece of fabric matching or complimenting the absorbent wiping band body is cut twice the desired width plus one-quarter inch and one-quarter inch longer than the desired length. The band fabric is folded lengthwise with the finished side on the inside. The folded band fabric is then stitched with thread on two adjacent sides and is inverted to exposed the finished side. The third side is then sewn.

Figure 2:
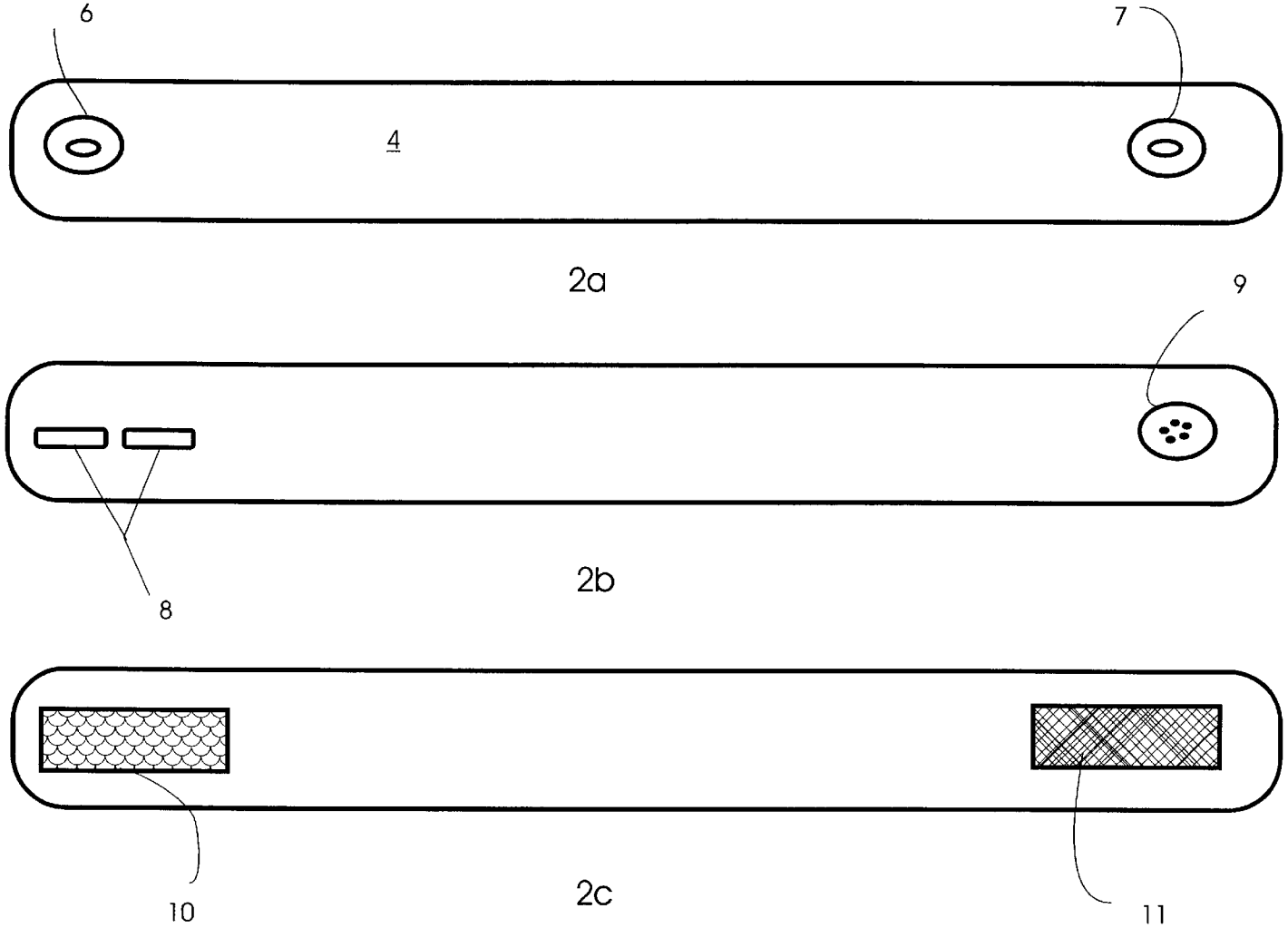
FIGS. 2A–C are front perspective views of an exemplary band with various mating fasteners sewn thereon.

FIGS. 2A–C are front perspective views of an exemplary band with various mating fasteners sewn thereon. As shown in FIGS. 2A–C, mating fasteners are sewn to the bands as shown (either mating snaps 6, 7 as in 2A, buttons and holes 8, 9 as in 2B, or hook and loop 10, 11 as in 2C). The fasteners are sewn properly to the ends of the bands 4A–C. This procedure is repeated to manufacture all three bands 4A, 4B and 4C.

The completed band 4A is attached permanently in the upper arm area of the absorbent wiping band and is the longest band of the three. Band 4B is attached permanently to the wrist area of the absorbent wiping band in a perpendicular manner and is the shortest band of the three. Band 4C is the middle elbow band as shown in FIG. 1. To attach the bands 4A–C, one end of each band 4A–C is sewn at the illustrated intervals perpendicularly along one side of the body of the absorbent wiping band. Alternatively, the middle band 4C does not need to be permanently attached and can be sewn onto itself in a continuous loop. In this case, band 4C is applied simply by looping it around the wearer's arm and over top of the absorbent wiping band. The compression of the stretch fabric maintains both the band 4C and the absorbent wiping band in place, and the user can easily remove the band 4C if he/she chooses not to wear it.

The free end of all three bands 4A–C are each equipped with the fasteners (snaps, hook and loop fasteners or buttons). If necessary, mating fasteners or buttonholes are sewn at the same intervals perpendicularly along the other side of the body of the absorbent wiping band.

Figure 3:
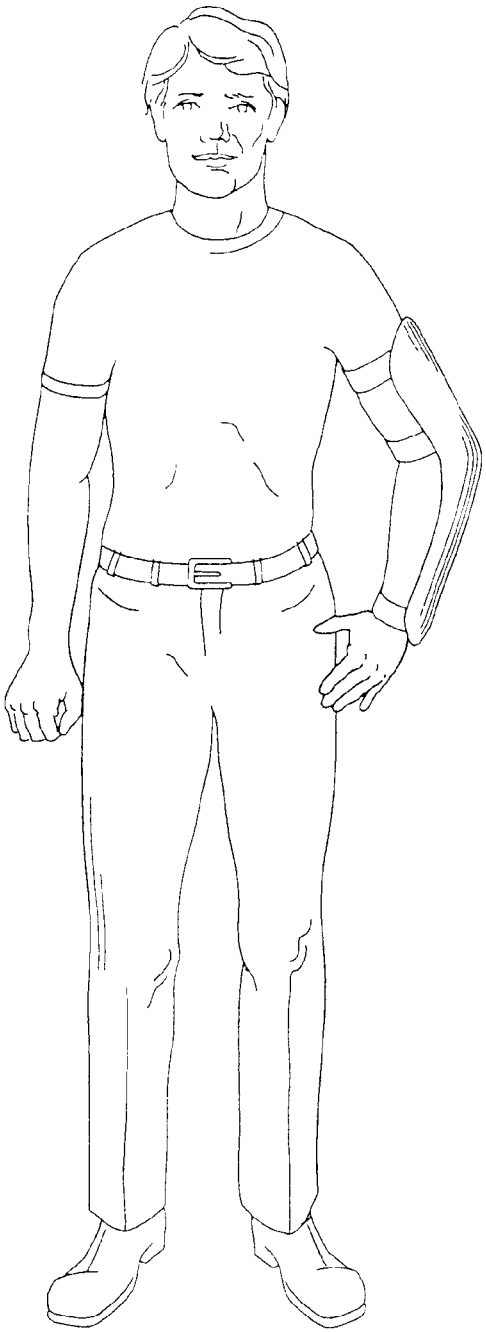
FIG. 3 illustrates the completed perspiration absorbent wiping band as described above and as worn by a user.

FIG. 3 illustrates the completed perspiration absorbent wiping band as described above and as worn by a user. The absorbent wiping band is releasably and conformably fastened around the wrist, elbow and upper arm to expose the main body of layered absorbent material extending upwardly along the upper arm beginning at the wrist. This way, when the wearer extends his/her arm outward the absorbent extent runs even with wearer's forehead and can be drawn inward to wipe the forehead for removal of perspiration. This provides a convenient and unobtrusive device for absorbing perspiration from the forehead or other areas. As a result, the when the user works up a sweat the inclination to wipe the forehead can be fulfilled without staining the shirt.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept.

For example, advertisements and promotional designs or artwork can be applied to the main body. In addition, the absorbent liner can be pre-treated with dessicants, scents and/or medications if desired by the wearer. It is to be understood, therefore, that the invention may be practiced otherwise than as specifically set forth herein.

What is claimed is:

1. A perspiration-wiping arm band adapted for attachment to the arm, comprising:

a pair of absorbent fabric sections cut to a length in the range of from 24–36 inches, and an inner absorbent liner sandwiched between said pair of absorbent fabric sections and secured therein to form an elongate perspiration absorbing pad;

a plurality of elastic bands encircling said absorbing pad for a releasable and conforming fit around the arm to expose said absorbing pad extending upwardly along the entire arm beginning at the wrist and to the upper arm across the elbow;

whereby a wearer of said perspiration-wiping arm band can straighten their arm to expose the absorbent band even with their forehead and can wipe the forehead therewith for removal of perspiration.

2. The perspiration-wiping arm band according to claim 1, wherein said plurality of bands includes a first strip attached at one end to said absorbent pad, and a second strip attached at one end to said absorbent pad, said first and second strips having fasteners at their free ends to fasten them in a loop around the upper arm and to said absorbent pad.

3. The perspiration-wiping arm band according to claim 2, wherein said plurality of bands further includes a third strip for securing the middle of said absorbent pad.

4. The perspiration-wiping arm band according to claim 3, wherein said third strip is attached at one end to a middle edge of said absorbent pad, and said third strip has fasteners at its free end to fasten it in a loop around the upper arm and to said absorbent pad.

5. The perspiration-wiping arm band according to claim 3, wherein said third strip is formed as a continuous loop for attachment around, but not to, said absorbent pad.

6. The perspiration-wiping arm band according to claim 1, wherein said pair of absorbent fabric sections are removably fastened together to allow removal of said inner absorbent liner.

* * * * *